US010074898B1

(12) United States Patent
Kuo et al.

(10) Patent No.: US 10,074,898 B1
(45) Date of Patent: Sep. 11, 2018

(54) ANTENNA FOR GPS AND HIGH BAND

(71) Applicant: Amazon Technologies, Inc., Reno, NV (US)

(72) Inventors: Jerry Weiming Kuo, San Jose, CA (US); Ulf Jan Ove Mattsson, Saratoga, CA (US); Adrian Napoles, Cupertino, CA (US)

(73) Assignee: Amazon Technologies, Inc., Reno, NV (US)

( * ) Notice: Subject to any disclaimer, the term of this patent is extended or adjusted under 35 U.S.C. 154(b) by 555 days.

(21) Appl. No.: 14/033,188

(22) Filed: Sep. 20, 2013

(51) Int. Cl.
*H01Q 1/50* (2006.01)

(52) U.S. Cl.
CPC ..... *H01Q 1/50* (2013.01)

(58) Field of Classification Search
CPC ..... H01Q 5/364; H01Q 5/40; H01Q 1/44
See application file for complete search history.

(56) References Cited

U.S. PATENT DOCUMENTS 6,667,723 B2 * 12/2003 Forrester ..... G01S 19/36 333/129
9,002,262 B1 * 4/2015 Kuo ..... H01Q 1/50 343/702
2011/0133995 A1 * 6/2011 Pascolini ..... H01Q 7/00 343/702
2012/0169547 A1 * 7/2012 Oh ..... H01Q 1/44 343/702
2012/0249378 A1 * 10/2012 Li ..... H01Q 1/243 343/702
2014/0091981 A1 * 4/2014 Komulainen ..... H01Q 1/521 343/893

* cited by examiner

*Primary Examiner* — Graham Smith
*Assistant Examiner* — Noel Maldonado
(74) *Attorney, Agent, or Firm* — Polsinelli LLP

(57) ABSTRACT

The present disclosure can provide a wideband antenna with a folded monopole structure that operates at GPS frequencies and high band (HB) frequencies. Accordingly, the wideband antenna can function as an integrated GPS and HB Diversity antenna for a computing device. In some embodiments, due to various constraints, the antenna can be designed to have a curved structure to fit within a corner of the computing device. The folded monopole antenna can comprise two substantially parallel conducting arms, which improves antenna performance. In some embodiments, the present disclosure can provide GPS and high band impedance matching for a signal received from the antenna in order to improve/ensure signal quality. The signal can be decoupled into a GPS signal portion and a high band signal portion for additional processing and/or information retrieval.

20 Claims, 12 Drawing Sheets

ANTENNA FOR GPS AND HIGH BAND

BACKGROUND

Computing devices are becoming more commonplace and are used for a wide variety of purposes. Every day, people use their computing devices to create, view, access, and/or interact with various types of content and information, especially as computing devices and applications are growing in number and in function. In some cases, users can use their computing devices to communicate. For example, a user can connect a computing device to a cellular or other communicational network to conduct a telephone call, engage in text messaging, and/or make a video call using the computing device. In some cases, the user can use the computing device to access network resources. For example, the user can connect the computing device to a communicational network configured to provide Internet connectivity and then use the computing device to access various online resources. Moreover, in some cases, the user can use the computing device for navigational purposes. In one example, using the computing device, the user can run an application that utilizes a Global Positioning System (GPS) to provide turn-by-turn driving directions. In these above-mentioned and other cases, there must be one or more antennas in the computing device to facilitate the communication of data. However, spatial limitations, bandwidth requirements, and other concerns can create challenges for antenna design and operation in computing devices.

BRIEF DESCRIPTION OF THE DRAWINGS

Various embodiments in accordance with the present disclosure will be described with reference to the drawings, in which.

DETAILED DESCRIPTION

Figure 1:
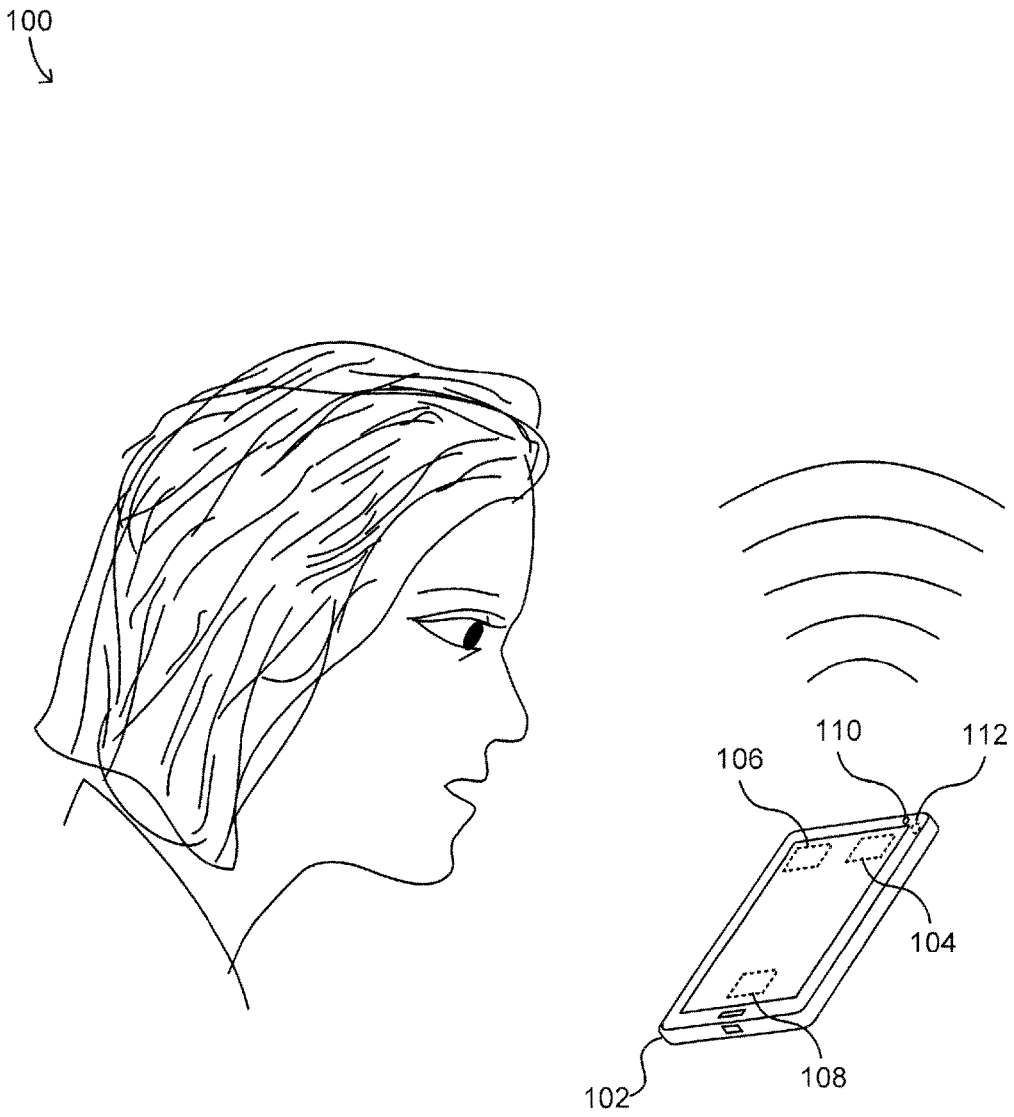
FIG. 1 illustrates an example environment in which aspects of the various embodiments can be utilized.

Systems and methods in accordance with various embodiments of the present disclosure overcome one or more of the above-referenced and other deficiencies in conventional approaches to antenna design and operation in computing devices. In particular, various embodiments of the present disclosure can provide a wideband antenna that integrates Global Positioning System (GPS) frequency operability and high band (HB) frequency operability.

Using computing devices to transmit and receive data wirelessly is becoming increasingly popular. Users can wirelessly connect their devices to various networks for various purposes. To perform various tasks, computing devices must be able to transmit and receive data signals at various frequencies (or bandwidths). As such, computing devices often require antennas that can operate across a broad range of frequencies (or bandwidths). For example, in order to communicate wirelessly in a given country using a cellular network, a computing device generally must be capable of communicating using one or more frequencies supported by cellular carriers in that country. However, in another country, the computing device might have to communicate at one or more different frequencies used by other cellular carriers in that other country. Furthermore, even within a country or locale, the computing device might have to be operable at different frequencies to perform different tasks. For example, the computing device might have to operate at GPS frequencies to perform GPS-related tasks and at cellular carrier frequencies to perform cellular-related tasks. Thus there can be numerous frequency/bandwidth requirements for antennas in computing devices.

Furthermore, there can be various other constraints and concerns associated with antenna design and operation. For example, there can be spatial limitations which dictate the size of the antenna and how the antenna is to fit within the computing device. Another example concern involves the metallic invasion or interference caused by various components surrounding or close in proximity to the antenna. The aforementioned concerns and other similar constraints can create challenges for designing, implementing, and/or operating antennas in computing devices.

Embodiments in accordance with the present disclosure can provide a wideband antenna, or antenna assembly, that is capable of operating across a relatively broad range of frequencies (or bandwidths) with respect to conventional devices. In some instances, a wideband antenna can operate at one or more component-specific frequencies, such as one or more GPS frequencies, as well as at various high band (HB) frequencies that can be used for cellular communication and the like. For example, a wideband antenna can operate at GPS frequencies including (but not limited to) those related to GPS L1, global navigation satellite system (GNSS), etc., and also at high band (HB) frequencies including (but not limited to) Band 1, Band 2, Band 3, Band 4 wireless communication services (WCS), and Band 7 for international roaming. It follows that a wideband antenna useful for GPS and high band (HB) frequencies can be operable at multiple bands ranging from, for example, approximately 1.55 GHz to approximately 2.7 GHz. As such, in some cases, the antenna can function as an integrated GPS and HB diversity antenna.

In some embodiments, due at least in part to various constraints and limitations, the wideband antenna can be a folded monopole antenna. Generally, a monopole antenna includes an elongated conductive material, such as a rod-shaped conductor or a flat elongated conductor. A folded monopole antenna can have a fold in the elongated conduct material. For example, the rod-shaped conductor or the flat elongated conductor can be folded into substantially a U-shape. Moreover, the overall structure of the wideband antenna can designed to be substantially curved. For example, the structure of the antenna can be configured to substantially fit within a curved corner or region of the computing device in which the antenna is installed. Furthermore, the folded monopole antenna can comprise at least a first conducting arm and a second conducting arm that are substantially parallel in structure. The first conducting arm can be associated with one end of the folded monopole structure while the second conducting arm can be associated with the other end of the folded monopole structure. In some embodiments, the first conducting arm can be attached to a wall structure of the computing device, such that the wall structure can provide structural support and electrical grounding to the folded monopole antenna. In some embodiments, the second conducting arm can be connected to a feeding element, which can relay signals received and transmitted via the antenna for further processing. Various other components can be used to provide structural support and/or rigidity to the second conducting arm as well in other embodiments.

Embodiments in accordance with the present disclosure can also provide for the processing of one or more signals received by and/or from such a wideband antenna. In some cases, a signal can be received from the antenna and transmitted to a GPS and high band pre-matching component of the computing device. The GPS and high band pre-matching component can correspond to and/or include impedance-matching circuitry configured to apply an impedance matching process to at least a portion of the received signal. The impedance-matching process can be used, in at least some embodiments, to attempt to improve signal quality, improve the signal to noise ratio, and/or reduce undesired properties associated with the signal. For example, the impedance-matching process can attempt to reduce noise present in the signal. In some cases, the impedance-matching process can attempt to maximize transferred power (and/or voltage) to improve a signal quality, or minimize signal refection to improve a signal to noise ratio. Having applied the impedance pre-matching, the signal can be transmitted to a process or component such as a signal extractor (e.g., GPS extractor) which is operable to decouple the signal, in this example, into at least a GPS signal portion and a high band signal portion. In some instances, additional impedance matching can be performed on the GPS signal portion by a GPS impedance matching unit to improve or ensure the signal quality of the GPS signal portion. For example, the GPS matching unit can match the GPS signal portion to a specified GPS impedance (e.g., 50 Ohms). In a similar fashion, in some instances, additional impedance matching can be performed on the high band signal portion by a high band impedance matching unit to improve or ensure the signal quality of the high band signal portion. In another example, the high band matching unit can match the high band signal portion to a specified high band impedance (e.g., 50 Ohms). Then, the GPS signal portion can be transmitted to a GPS port and the high band signal portion to a high band port, respectively. In one example, the GPS signal portion can be processed via the GPS port to retrieve GPS data while the high band signal portion can be processed via the high band port to retrieve cellular data.

Other variations, functions, and advantages are described and suggested below as may be provided in accordance with the various embodiments.

FIG. 1 illustrates an example environment 100 in which aspects of the various embodiments can be utilized. The example environment 100 can comprise an example computing device 102. The example computing device 102 can be a smartphone, tablet computer, laptop or notebook computer, desktop computer, gaming console, wearable computer (e.g., a watch or glasses), smart television, media player (e.g., smart DVD player), or camera, etc. Various other types of devices can be utilized with the present disclosure as well, and at least some of these devices are discussed in more detail below with reference to FIG. 7 and FIG. 8.

As shown in FIG. 1, the computing device 102 can comprise one or more antennas (e.g., 104, 106, 108), antenna elements, or antenna assemblies. In the example of FIG. 1, antenna 104 can be a wideband integrated GPS and HB (e.g., HB diversity) antenna, antenna 106 can be a WiFi antenna (e.g., Dual Band WiFi antenna), and antenna 108 can be a low band antenna (e.g., low band diversity antenna). Although not necessarily drawn to scale, FIG. 1 can illustrate that the elements can be positioned at different locations in the device. For example, in some cases the WiFi antenna 106 can be installed at or near the upper left corner of the device 102 and the low hand antenna 108 can be at or near the bottom portion of the device 102. In these cases, the wideband antenna 104 can be installed at or near the upper right corner of the computing device 102. Each of the antennas (e.g., 104, 106, 108) can be physically separated in order to reduce potential radiation interferences or other potential problems caused by placing the antennas too close together.

Moreover, the computing device 102 can comprises one or more image capture components, such as a front facing camera 110 and a rear facing camera 112. The one or more image capture components can create spatial challenges for the wideband antenna 104. As shown in FIG. 1, the one or more image capture components (e.g., 110, 112) can be located near the wideband antenna 104. Thus, the cameras can take up space and place physical limitations on the design of the antenna 104.

Although not illustrated in FIG. 1, there can be many other components included in the computing device 102 which can constrain and limit how the wideband antenna 104 can be designed, implemented, and/or used. For example, other components that are not illustrated in FIG. 1 can include (but are not limited to) a radio frequency choke (RFC), a flash LED, flash circuitry, metal inlays, and metal rings, which can contribute to metallic invasion or interference with respect to antenna operations. Various embodiments of the present disclosure provide an improved design for a wideband antenna capable of operating at GPS frequencies (or bandwidths) and high band frequencies (or bandwidths), in light of the various design constraints and limitations.

Figure 2A:
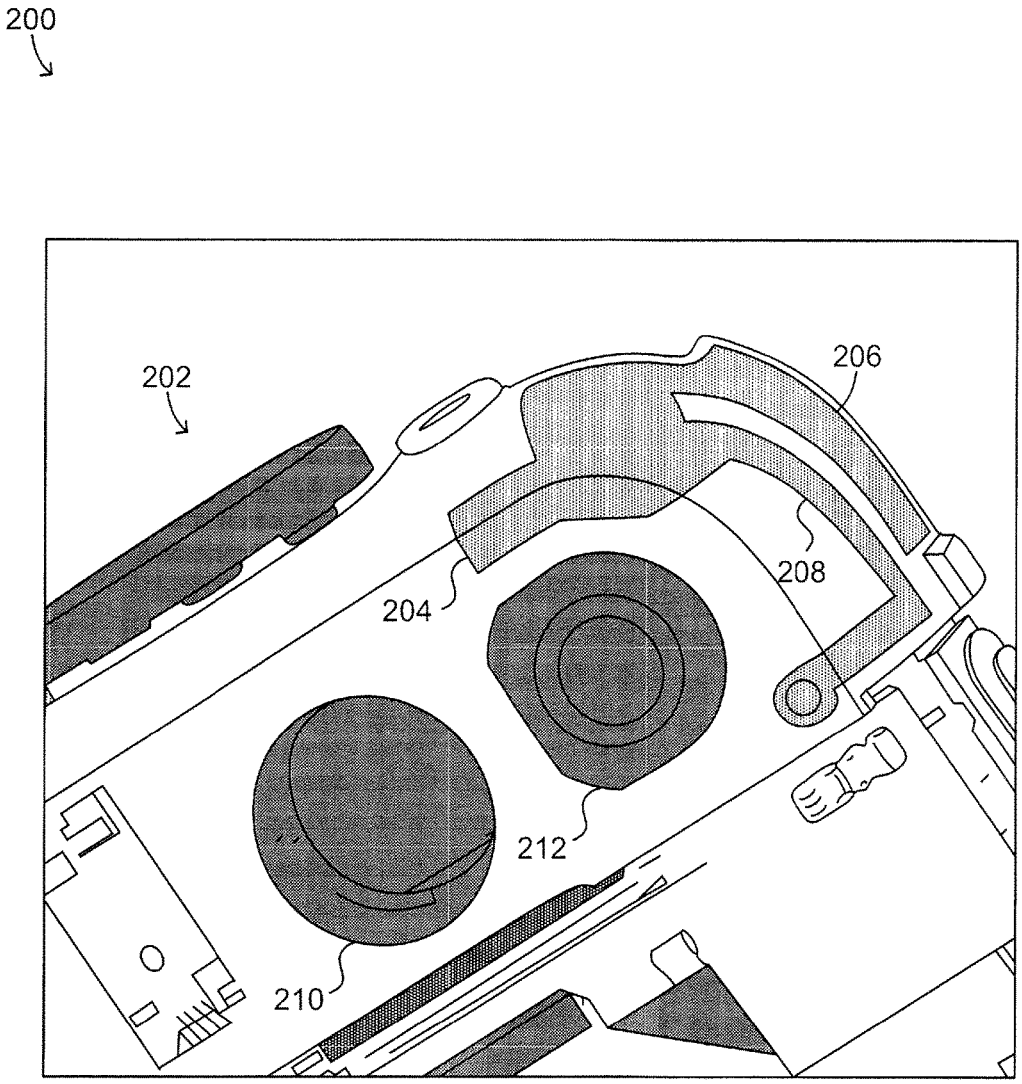
FIG. 2A illustrates a front view of an upper right corner portion of an example computing device including an example GPS and high band antenna.

With reference now to FIG. 2A, a front view 200 of an upper right corner portion of an example computing device 202 including an example GPS and high band antenna 204 is illustrated. The front view 200 of the example computing device 202 shows a schematic design for the wideband antenna 204. In some embodiments, to utilize the radiation volume efficiently, the overall structure of the wideband antenna 204 can be designed to fit in a region corresponding to and/or near a curved corner (e.g., upper right corner) of the computing device 202. As such, the wideband antenna 204 can be configured to have a substantially curved structure or a structure that is within an allowable deviation from being compatible to fit with and/or substantially match a curvature of a corner of the device 202 where the antenna 204 is implemented.

In some embodiments, the wideband antenna 204 can be what is referred to as a folded monopole antenna. The wideband antenna 204 can have two (or more) substantially parallel conducting arms or arm portions. For example, the illustrated wideband folded monopole antenna 204 has a first conducting arm 206 associated with one end of the folded monopole and a second conducting arm 208 associated with the other end of the folded monopole. To improve wideband radiation efficiency, the folded monopole antenna 204 can be designed such that the first conducting arm 206 and the second conducting arm 208 are substantially parallel in structure (i.e., structurally parallel within an allowable deviation), as shown in FIG. 2A. It can be seen that the arms may actually be curved, and may have different shapes, such that the arms may be considered to be substantially parallel in only one or more directions, and that shape and/or curvature may vary based at least in part upon design and performance characteristics.

Moreover, as discussed previously, the presence of one or more image capture components (e.g., front facing camera 210, rear facing camera 212, etc.) and/or other such elements can serve as spatial limitations for the antenna 204. Another factor in designing the structure of the wideband folded monopole antenna 204 to be substantially curved is to account at least in part for these spatial limitations. Therefore, although conventional GPS antennas are typically approximately 25 millimeters in length, the wideband folded monopole antenna 204 of the present disclosure can have a trace length of approximately 10 millimeters (i.e., within an allowable deviation from 10 millimeters) in at least some embodiments.

Figure 2B:
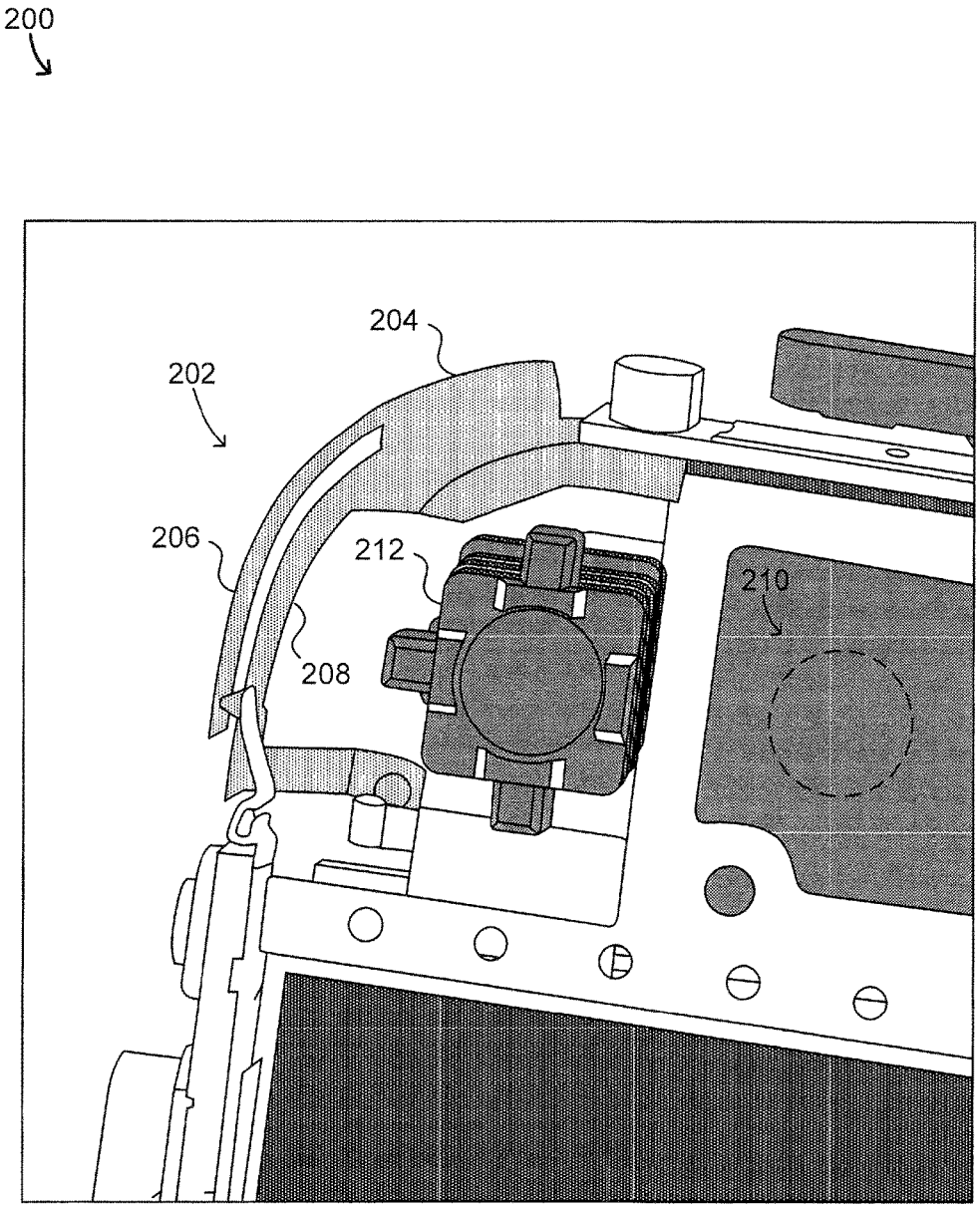
FIG. 2B illustrates a rear view of the upper right corner portion of the example computing device of FIG. 2A including the example GPS and high band antenna.

Turning now to FIG. 2B, a rear view 250 of the upper right corner portion of the example computing device 202 including the example GPS and high band antenna 204 is illustrated. The rear view 250 provides another perspective of the device 202, the wideband folded monopole antenna 204, the conducting arms (e.g., 206, 208) of the antenna 204, and the one or more image capture components (e.g., front facing camera 210, rear facing camera 212, etc.). As illustrated, the design can take into account factors such as the shape of the device and spatial limitations of components near, or adjacent to, the antenna.

Figure 3A:
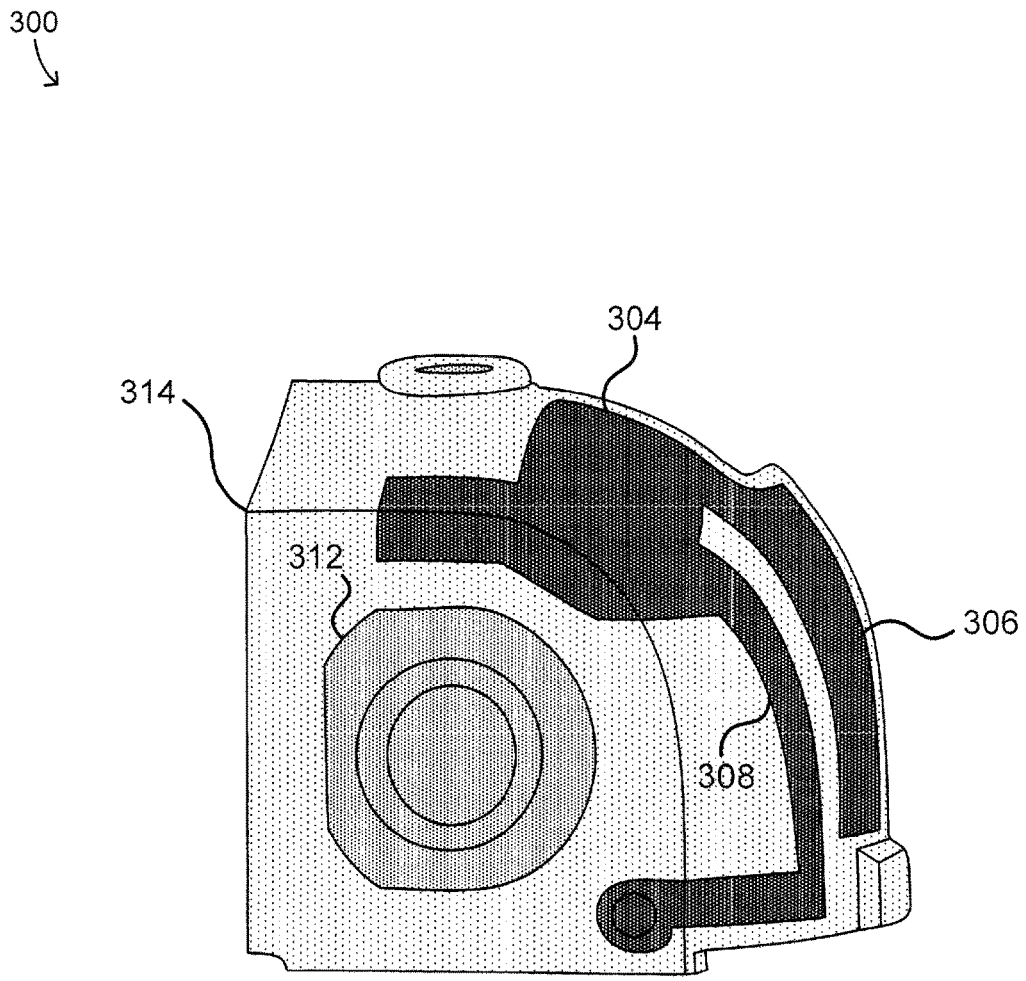
FIG. 3A illustrates a front view of an example wideband antenna, such as a GPS and high band antenna, as well as various related components.

FIG. 3A illustrates a simplified front view 300 of an example wideband antenna 304, such as a GPS and high band antenna, as well as various related components. The front view 300 shows the wideband antenna 304 including a first conducting arm 306 and a second conducting arm 308 that are substantially parallel in structure. The front view 300 also shows a layer of plastic material 314 that can be utilized, such as in a laser direct structuring (LDS) process, to generate and/or support the conductive material of the antenna 304. For example, the design, form, and/or shape, etc., of the antenna 304 can be drawn, stamped, carved, or otherwise formed out on the layer of plastic material 314 using one or more lasers or other such devices. In some embodiments, the antenna 304 then can be developed or formed (e.g., plated) using a chemical plating process, deposition process, inlay process, etc. An LDS process can enable the antenna 304 to be placed closer to the corner of the computing device, which can help to improve radiation effectiveness/efficiency over antennas formed by various other processes.

Figure 3B:
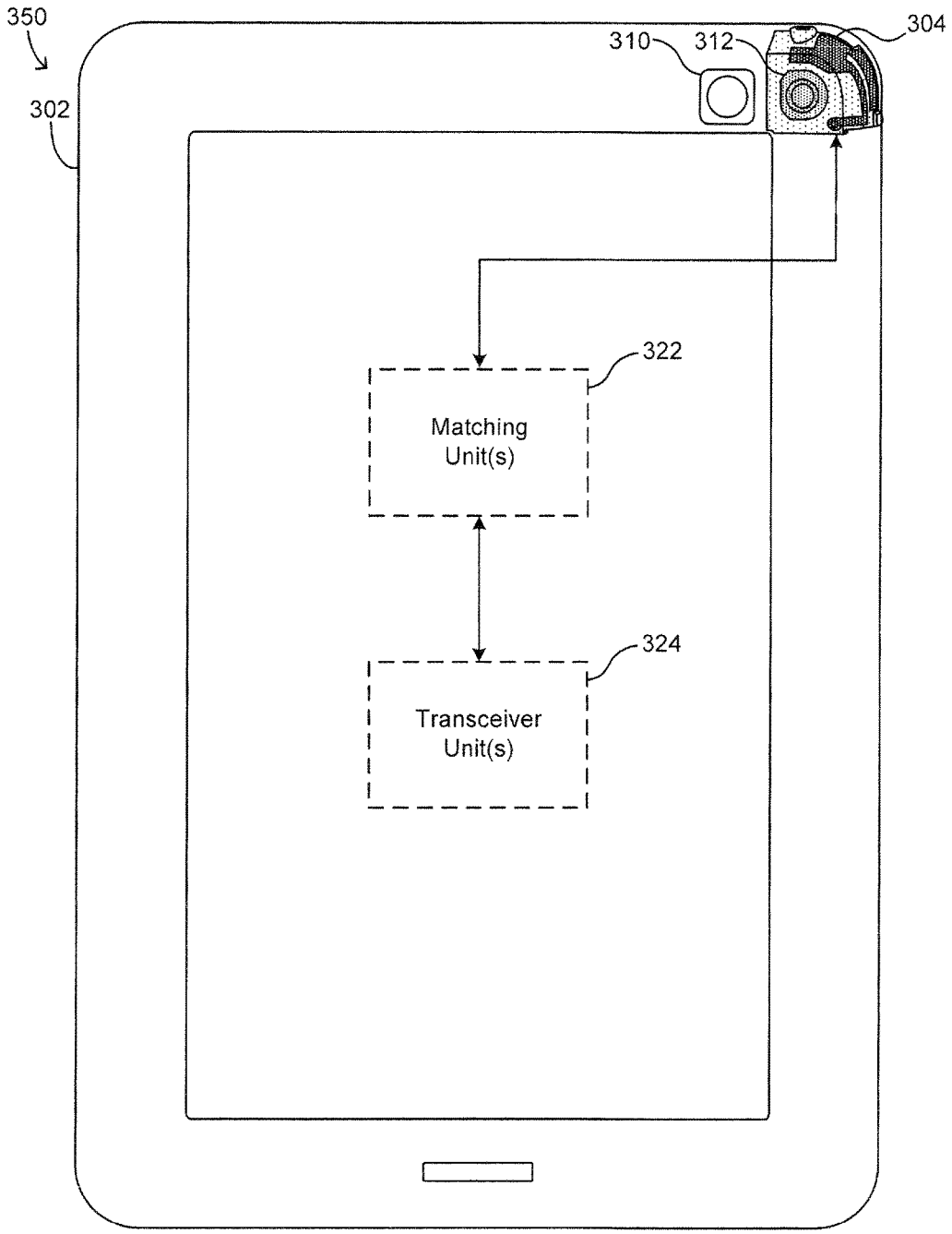
FIG. 3B illustrates a front view of an example computing device embodiment including the example GPS and high band antenna of FIG. 3A.

FIG. 3B illustrates a front view 350 of an example computing device embodiment 302 including the example GPS and high band antenna 304 of FIG. 3A. FIG. 3B can illustrate the example antenna 304 in relation to the example computing device embodiment 302. Although not necessarily drawn to scale, FIG. 3B shows how one or more image capture components (e.g., front facing camera 310, rear facing camera 312, etc.) can place spatial restraints on the design of the wideband antenna 304. FIG. 3B also shows the overall structure (e.g., substantially curved structure) of the antenna 304 that is configured to improve radiation effectiveness/efficiency while still being capable of fitting substantially within the corner of the computing device 302. Moreover, FIG. 3B shows that the antenna 304 can be connected to one or more matching units 322 and to one or more transceivers 324, which will be discussed in more detail with reference to FIG. 5.

Figure 4A:
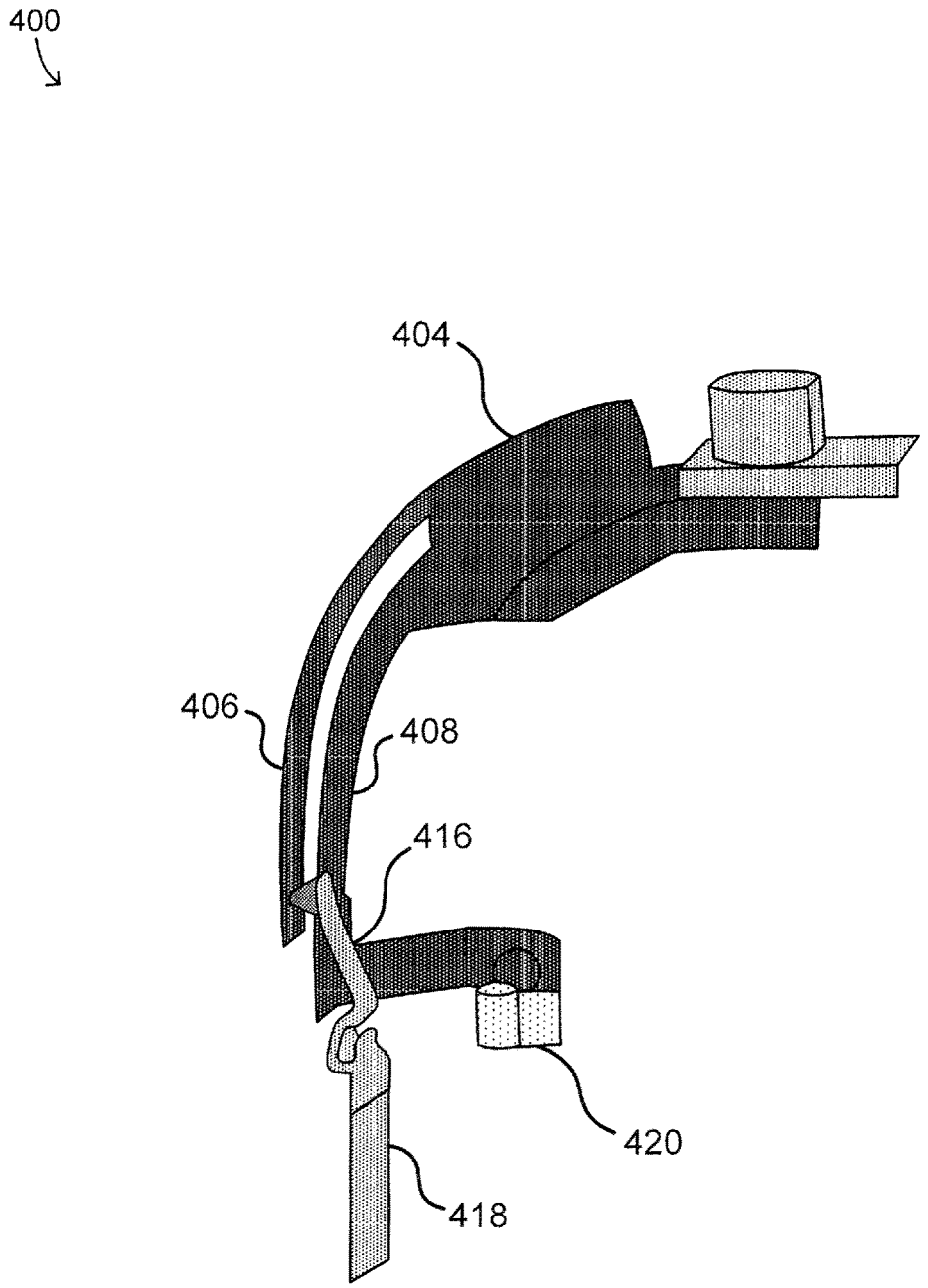
FIG. 4A illustrates a rear view of an example wideband antenna, such as a GPS and high band antenna, as well as various related components.

FIG. 4A illustrates a simplified rear view 400 of an example wideband antenna 404, such as a GPS and high band antenna, as well as various related components. (For illustrative purposes, the plastic material useful for an LDS process have been omitted from FIG. 4A.) As discussed previously, the example wideband antenna 404 can be a folded monopole antenna having a first conducting arm 406 and a second conducting arm 408 that are within an allowable deviation from being structurally parallel to each other. In FIG. 4A, the first conducting arm 406 of the wideband antenna 404 is shown to be attached to a clip 416. The clip 416 can be attached to (or can be a part of) a wall structure 418 of the computing device. In some cases, the wall structure 418 can be part of an enclosure for the computing device. In some cases, the wall structure 418 can be part of a frame of the computing device. For example, the wall structure 418 can correspond to a metal and/or plastic frame that at least partially surrounds various other components in the interior of the computing device. The clip 416 (and the wall structure 418) can provide structural support and/or electrical grounding for the wideband folded monopole antenna 404. In some embodiments, the clip 416 can be made of a relatively rigid material, such as a metal.

In addition, the rear view 400 shows that the second conducting arm 406 of the wideband antenna 404 is connected to a feeding element 420 (e.g., a spring clip). The feeding element 420 can be connected to one or more transceivers configured to process signals received and transmitted via the antenna 404. In other words, the feeding element 420 can serve as a connection in the communication path between the antenna 404 and the one or more transceivers. In some instances, the feeding element 420 can be a clip made out of conductive material and configured to transmit one or more signals between the antenna 404 and the one or more transceivers. For example, the feeding element 420 can be a metal structure that serves as a connection point in the communication path from the antenna 404 to the one or more transceivers (and vice versa).

Figure 4B:
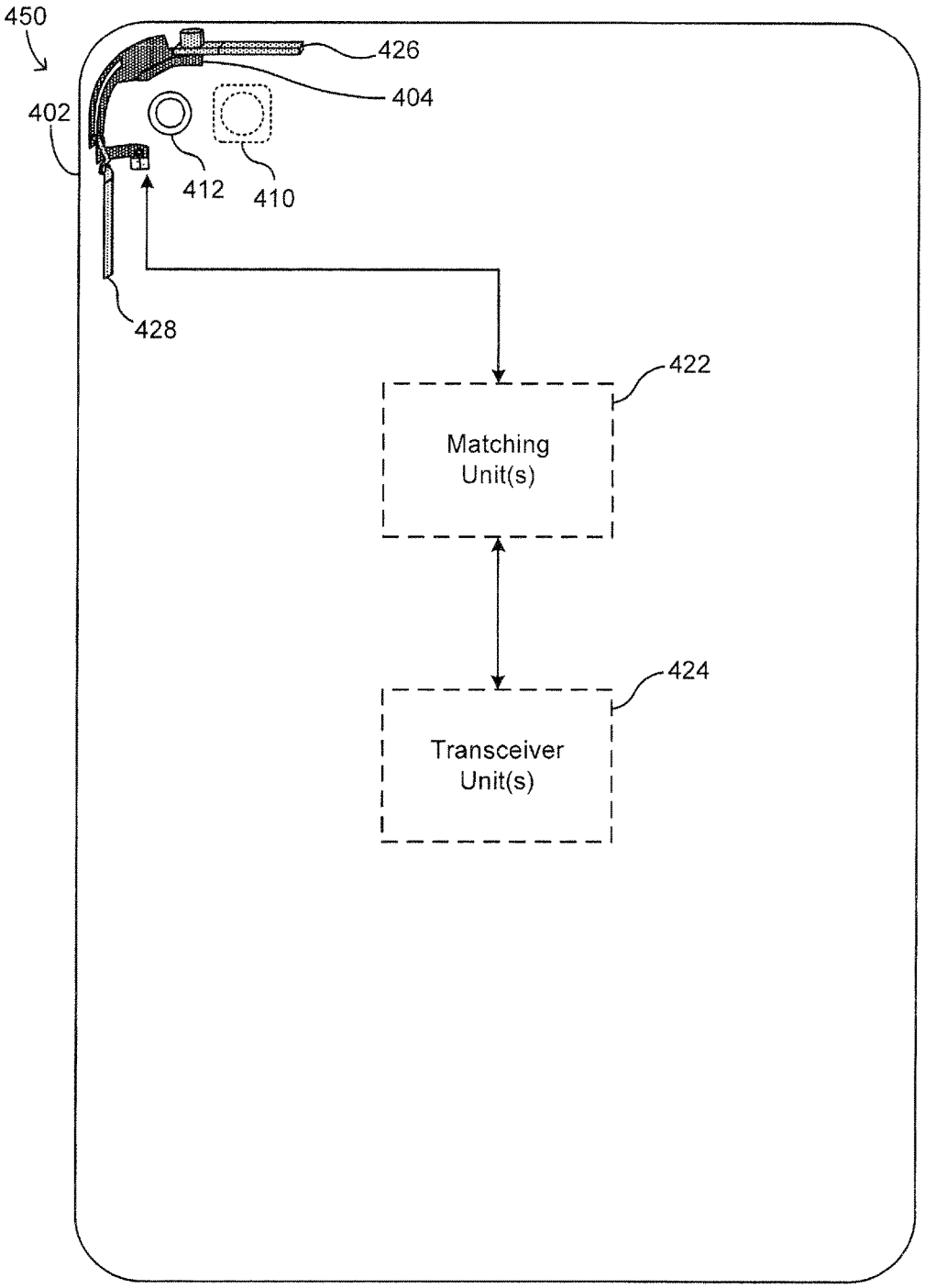
FIG. 4B illustrates a rear view of an example computing device embodiment including the example GPS and high band antenna of FIG. 4A.

FIG. 4B illustrates a rear view 450 of an example computing device embodiment 402 including the example GPS and high band antenna 404 of FIG. 4A. FIG. 4B can illustrate the example antenna 404 in relation to the example computing device embodiment 402. Although not necessarily drawn to scale, FIG. 4B shows how one or more image capture components (e.g., front facing camera 410, rear facing camera 412, etc.) can place spatial restraints on the design of the antenna 404. FIG. 4B again shows the substantially curved overall structure of the antenna 404 configured to improve radiation effectiveness/efficiency in the limited volume of the device corner. Moreover, FIG. 4B shows that the antenna 404 can be connected to one or more matching units 422 and to one or more transceivers 424, which will be discussed in more detail with reference to FIG. 5.

Figure 5:
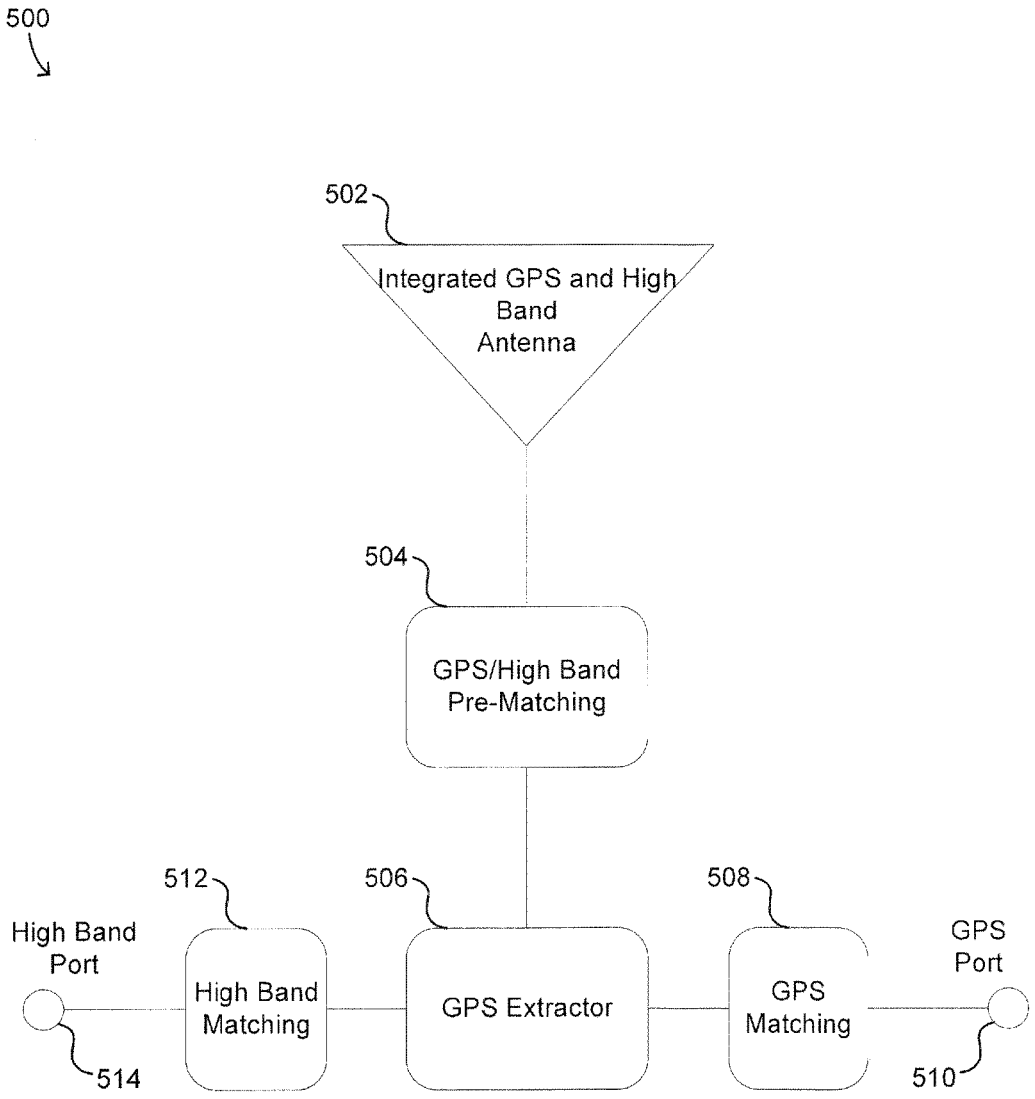
FIG. 5 illustrates an example system embodiment for implementing a GPS and high band antenna.

Turning now to FIG. 5, an example system embodiment 500 for implementing a GPS and high band antenna is shown. The example system embodiment 500 includes a wideband antenna 502 that operates at integrated GPS and high band frequencies, as discussed above. The example system 500 can also include a GPS and high band pre-matching unit 504, a GPS extractor unit 506, a GPS matching unit 508, a GPS port 510, a high band matching unit 512, and a high band port 514, among other such options.

In some embodiments, the antenna 502 (e.g., a folded monopole antenna with two parallel conducting arms) can be connected to the GPS and high band pre-matching unit 504, as shown in FIG. 5. In some cases, the GPS and high band pre-matching unit 504 can comprise circuitry configured to apply an impedance matching process to a signal received via the antenna 502. It follows that the antenna 502 can be connected to the pre-matching unit 504. For example, the antenna 502 can be connected to a feeding element (e.g., 420 in FIG. 4A) which is connected to the pre-matching unit (e.g., circuitry) 504. In some cases, the signal received via the antenna 502 can correspond to the entire signal received at the antenna 502 and/or can correspond to various signals portions having various bands or frequencies.

In some instances, unit 504 can be referred to as the "pre-matching" unit because unit 504 performs impedance matching before the GPS matching unit 508 and the high band matching unit 512. The impedance matching process performed by unit 504 can attempt to match the impedance associated with the signal received from the antenna 504 to a specified (target) impedance (e.g., within an allowable deviation from 50 Ohms). As a result, the impedance matching process performed by unit 504 can improve signal quality, improve a signal to noise ratio, and/or reduce (or eliminate) one or more undesired properties, such as noise, that may be present in the signal from the antenna 502. In some embodiments, the impedance matching unit 504 can be implemented using hardware, software, and/or any combination of hardware and software. For example, the impedance matching unit 504 can be implemented utilizing circuitry (e.g., transformers, resistors, inductors, capacitors, and/or transmission lines, etc.) and/or algorithms.

The system embodiment 500 of FIG. 5 also includes the GPS extractor unit 506. The GPS extractor unit 506 can be configured to decouple the signal from the antenna 502 (after being pre-matched) into a GPS signal portion and a high band signal portion. In some embodiments, the GPS extractor unit 506 can filter the signal received from the antenna 502, such that the signal from the antenna 502 can be separated into the GPS signal portion and the high band signal portion. The GPS signal portion can be transmitted to a GPS matching unit 508 which performs additional impedance matching to further improve or ensure the quality of the GPS signal portion. After the impedance matching by the GPS matching unit 508, the GPS signal portion can be transmitted to the GPS port 510. In some cases, the GPS port 510 can be connected to (or be a part of) a GPS transceiver configured to process the UPS signal portion (e.g., for GPS related use). In some embodiments, the extractor unit 506 can be implemented using hardware, software, and/or any combination of hardware and software. For example, the extractor unit 506 can be implemented utilizing circuitry and/or algorithms for processing received signals.

Further, the high band signal portion can be transmitted to a high band matching unit 512 which performs additional impedance matching to further improve or ensure the quality of the high band signal portion. After the impedance matching by the high band matching unit 512, the high band signal portion can be transmitted to the high band port 514. In some cases, the high band port 514 can be connected to (or be a part of) a high band transceiver configured to process the high band signal portion (e.g., for cellular related use).

In some embodiments, although not explicitly illustrated in FIG. 5, the GPS transceiver and the high band transceiver can be included in a signal transceiver unit in the system 500. In some embodiments (not explicitly illustrated in FIG. 5), the GPS transceiver and the high band transceiver can correspond to separate transceiver units in the system 500.

In one example, a signal is received via the wideband UPS and HB integrated antenna 502. The signal is transmitted to the GPS-HB pre-matching unit 504, where an impedance matching process (e.g., 50 Ohms) is applied to the signal. The signal is then transmitted to the GPS extractor unit 506, which decouples the signal into a GPS signal portion and a high band signal portion. Using the GPS matching unit 508, an additional impedance matching process is applied to the GPS signal portion. The resulting GPS signal portion is transmitted to the GPS port 510 to be processed. Likewise, an additional impedance matching process is applied to the high band signal portion using the high band matching unit 512, and the resulting high band signal portion is transmitted to the high band port 514 to be processed.

In some embodiments, the GPS-HB pre-matching unit 504, the GPS matching unit 508, and/or the high band matching unit 512 can provide a tunable feature. In one example, since a high band signal can, in some cases, range from approximately 1.7 GHz to 2.7 GHz, the impedance matching applied to the high band signal portion by the high band matching unit 512 might not produce satisfactory results. As such, the high band matching unit 512 can be replaced or modified to provide a tunable feature (i.e., tunable option). The tunable feature for the high band matching unit 512 can enable the high band signal portion to be tuned to a narrower frequency band (i.e., one or more target high band frequencies) which can produce better matching. Similarly, the GPS-HB pre-matching unit 504 and/or the GPS matching unit 508 can be replaced or modified to provide the tunable feature.

With regard to antenna performance, the overall radiation performance over the aggregated RF system and the antenna intrinsic efficiency can be referred to as "Antenna system efficiency". For HB frequencies, test cases for evaluating the Over-the-Air (OTA) radiation performance can include Free Space (FS), Right Hand holding (RH), and Besides Head and Hand Right (BHHR). Test cases can also include Left Hand holding (LB) and Besides Head and Hand Light (BHLR). Table A (below) provides a summary of example simulated test results measuring high band antenna system efficiency.

TABLE A

| Band | Tx/Rx | L/M/H | Freq. (MHz) | High Band Antenna System Efficiency (dB) FS | Avg | Min | HR | Avg | Min |
|---|---|---|---|---|---|---|---|---|---|
| 1 | Rx | L | 2110 | −7.23 | −7.3 | −7.4 | −7.86 | −8.01 | −8.2 |
| 1 | Rx | M | 2140 | −7.35 | | | −8.07 | | |
| 1 | Rx | H | 2170 | −7.40 | | | −8.15 | | |
| 2 | Rx | L | 1930 | −6.60 | −6.3 | −6.6 | −7.18 | −6.93 | −7.2 |
| 2 | Rx | M | 1960 | −6.20 | | | −6.86 | | |
| 2 | Rx | H | 1990 | −6.10 | | | −6.76 | | |
| 3 | Rx | L | 1805 | −8.19 | −7.7 | −8.2 | −9.29 | −8.81 | −9.3 |
| 3 | Rx | M | 1843 | −7.58 | | | −9.08 | | |
| 3 | Rx | H | 1880 | −7.45 | | | −8.14 | | |
| 4 | Rx | L | 2110 | −7.23 | −7.3 | −7.4 | −7.86 | −7.99 | −8.2 |
| 4 | Rx | M | 2133 | −7.35 | | | −7.96 | | |
| 4 | Rx | H | 2155 | −7.38 | | | −8.15 | | |
| 5 | Rx | L | 869 | | 0 | 0 | | 0 | 0 |
| 5 | Rx | M | 881.5 | | | | | | |
| 5 | Rx | H | 894 | | | | | | |
| 7 | Rx | L | 2620 | −7.5 | −6.8 | 7.5 | −9.54 | −8.45 | −9.5 |
| 7 | Rx | M | 2655 | −6.7 | | | −8.49 | | |
| 7 | Rx | H | 2690 | −6.3 | | | −7.55 | | |

| Band | High Band Antenna System Efficiency (dB) HL | Avg | Min | BHHR | Avg | Min | BHHL | Avg | Min |
|---|---|---|---|---|---|---|---|---|---|
| 1 | −7.8 | −7.87 | −7.95 | −14.01 | −13.9 | −14.01 | | 0 | 0 |
| 1 | −7.86 | | | −13.95 | | | | | |
| 1 | −7.95 | | | −13.86 | | | | | |
| 2 | −6.93 | −6.8 | −6.93 | −13.93 | −13.7 | −13.93 | | 0 | 0 |
| 2 | −6.896 | | | −13.54 | | | | | |
| 2 | −6.59 | | | −13.6 | | | | | |
| 3 | | 0 | 0 | −15.89 | −15.3 | −15.89 | −14.4 | −13.9 | −14.4 |
| 3 | | | | −15.2 | | | −14.03 | | |
| 3 | | | | −14.8 | | | −13.34 | | |
| 4 | −7.8 | −7.92 | −8.1 | −14.01 | −14 | −14.01 | | 0 | 0 |
| 4 | −7.86 | | | −13.95 | | | | | |
| 4 | −8.1 | | | −13.95 | | | | | |
| 5 | | 0 | 0 | | 0 | 0 | | 0 | 0 |
| 5 | | | | | | | | | |
| 5 | | | | | | | | | |
| 7 | | 0 | 0 | −12.45 | −12 | −12.45 | −10.66 | −10 | −10.7 |
| 7 | | | | −12.11 | | | −10.01 | | |
| 7 | | | | −11.61 | | | −9.48 | | |

For GPS frequencies, in addition to the test cases described above, two important benchmarks involve pattern ratios for Upper Hemisphere Isotropic Sensitivity (UHIS) and for Partial Isotropic GPS Sensitivity (PIGS). UHIS pattern ratios can measure how well a GPS signal communicates to a satellite in the "sky" (e.g., directly on top). PIGS pattern ratios can measure how well a GPS signal communicates when the GPS signal is 120 degrees from the satellite in the "sky" and reflected back from the ground. Table B (below) provides a summary of example simulated test results measuring GPS antenna system efficiency.

TABLE B

| FS | | RF System Efficiency | Antenna Intrinsic Efficiency | Antenna System Efficiency |
|---|---|---|---|---|
| | | −2.44 | −2.42 | −4.86 |
| | | −3.10 | −2.4 | −5.50 |
| | | Partial Pattern Compared to Full Pattern (dB) | | |
| | UHIS Pattern Ratio | 0.58 | −2.35 | |
| | PIGS Pattern Ratio | 0.84 | −0.77 | |

| HR | RF System Efficiency | Antenna Intrinsic Efficiency | Antenna System Efficiency |
|---|---|---|---|
| | −2.60 | −4.13 | −6.73 |
| | −3.28 | −4.15 | −7.43 |

TABLE B-continued

| | Partial Pattern Compared to Full Pattern (dB) | |
|---|---|---|
| UHIS Pattern Ratio | 0.48 | −3.21 |
| PIGS Pattern Ratio | 0.72 | −1.43 |

| BHHR | RF System Efficiency | Antenna Intrinsic Efficiency | Antenna System Efficiency |
|---|---|---|---|
| | −2.37 | −10.6 | −12.97 |
| | −2.92 | −10.4 | −13.32 |
| | Partial Pattern Compared to Full Pattern (dB) | | |
| UHIS Pattern Ratio | 0.43 | −3.66 | |
| PIGS Pattern Ratio | 0.72 | −1.41 | |

Figure 6A:
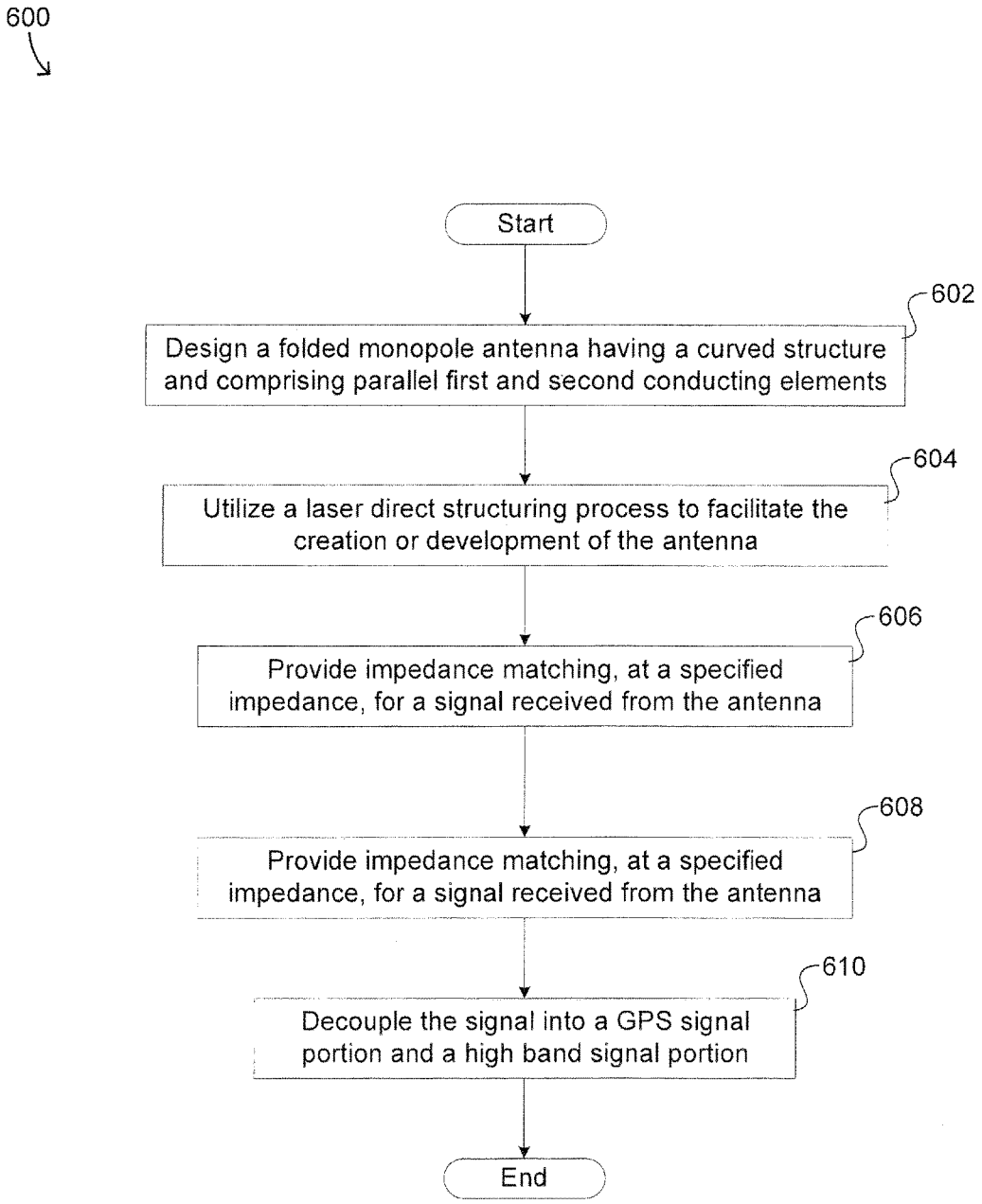
FIG. 6A illustrates an example method embodiment for providing a GPS and high band antenna.

Referring now to FIG. 6A, FIG. 6A illustrates an example method embodiment 600 for providing a GPS and high band antenna, although other such antennas can be provided as well in other embodiments as discussed elsewhere herein. It should be understood that there can be additional, fewer, or alternative steps performed in similar or alternative orders, or in parallel, within the scope of the various embodiments unless otherwise stated. At step 602, the example method embodiment 600 can design a wideband antenna to be a folded monopole antenna comprising a first conducting element associated with a first end of the folded monopole antenna and a second conducting element associated with a second end of the folded monopole antenna. In some cases, the first conducting element and the second conducting element can be substantially parallel in structure. Also, the antenna can be designed to have a substantially curved structure configured to fit at a corner of a computing device. In some embodiments, the method 600 can utilize a laser direct structuring (LDS) process to facilitate the creation or development of the antenna, at step 604. For example, the design, form, and/or shape, etc., of the antenna can be drawn, stamped, carved, or otherwise formed out on a layer of plastic material using one or more lasers of the LDS process. The antenna can then be formed (e.g., plated) using a chemical plating process, deposition process, and/or inlay process, etc.

At step 606, the method 600 can configure the antenna to operate at GPS frequencies and high band frequencies. Further, step 608 can include providing impedance matching, at a specified impedance, for a signal received from the folded monopole antenna. The impedance matching can be performed using an impedance matching unit connected to the folded monopole antenna. Then at step 610, the method 600 can decouple the signal into a GPS signal portion and a high band signal portion. The decoupling can be performed using a GPS extractor unit connected to the impedance matching unit.

Figure 6B:
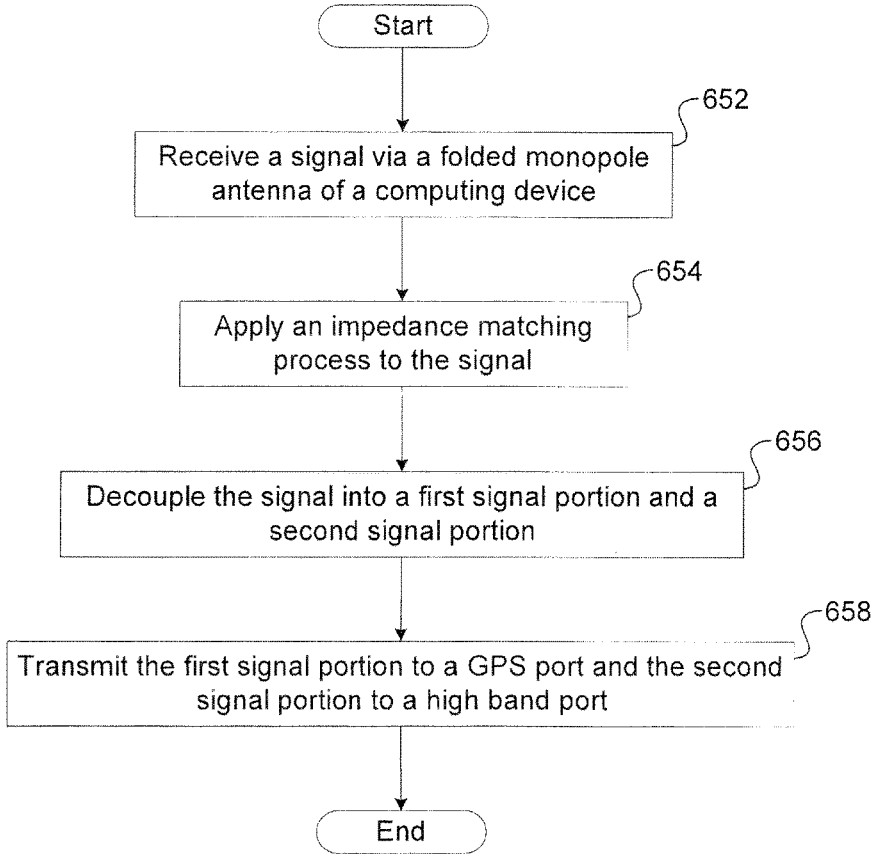
FIG. 6B illustrates an example method embodiment for providing a GPS and high band antenna.

FIG. 6B illustrates an example method embodiment 650 for providing a GPS and high band antenna. Again, it should be understood that there can be additional, fewer, or alternative steps performed in similar or alternative orders, or in parallel, within the scope of the various embodiments unless otherwise stated. The example method embodiment 650 can receive a signal via a folded monopole antenna of a computing device, at step 652. In some embodiments, the folded monopole antenna can be configured to operate at GPS frequencies and high hand frequencies. In some instances, the antenna can comprise two conducting elements that are substantially parallel to each other.

The example method 650 can apply an impedance matching process to the signal, at step 654. The impedance matching process can cause the signal to match a specified impedance within an allowable deviation. Then at step 656, the method 650 can decouple the signal into a first signal portion and a second signal portion. In some cases, the first signal portion can be associated with one or more GPS frequencies and the second signal portion can be associated with one or more high band frequencies.

Step 658 can include transmitting the first signal portion to a GPS port of the computing device and the second signal portion to a high band port of the computing device. In some embodiments, the GPS port can be connected to (or be a part of) a GPS transceiver unit and the high band port can be connected to (or be a part of) a high band transceiver unit. In some embodiments, the method 650 can transmit the first signal portion to a GPS signal processing element of the device and transmit the second signal portion to a high band signal processing element of the device. In some cases, the GPS signal processing element and the high band signal processing element can work in conjunction and/or reside together (e.g., as a signal processing unit).

Further, in some embodiments, the folded monopole antenna can comprise a first layer of copper material, a second layer of nylon material, and a third layer of gold plating material. For example, the folded monopole antenna can be formed by an approximate 60 micron layer of copper material, an approximate 50 micron layer of 50% glass-filled nylon material on top of the copper material, and another layer of gold plating on top of the nylon material.

Moreover, in some embodiments, instead of or in addition to LDS, the wideband antenna can be developed or formed using a metal stamping process or a flex circuit process. A stamped metal antenna can be formed using a metal forming manufacturing process in which a machine or stamping press punches a sheet of metal in accordance with an antenna design. A flex circuit antenna can be assembled in a process that mounts or prints components on flexible substrates (e.g., plastic). Further, in some embodiments, an injection molding process such as a two-shot molding process can be used to form the antenna. For example, in a two-shot molding process, a first resin that is platable (e.g., a platable plastic) can be shot, and then a second resin that is not platable (e.g., a non-platable plastic) can be shot, and a chemical process can be applied to form the antenna. Also, in some embodiments, inkjet printing or pad printing can be utilized to form the antenna. For example, inkjet printing can print the antenna on top of a plastic material, and pad printing can print conductive ink on a pad via a stencil to form the antenna. A person of ordinary skill in the art would recognize other similar processes for developing or forming the wideband antenna consistent with the present disclosure.

It is further contemplated that there can be many other implementation variations, uses, and/or applications associated with the various embodiments of the present disclosure that a person having ordinary skill in the art would recognize.

Figure 7:
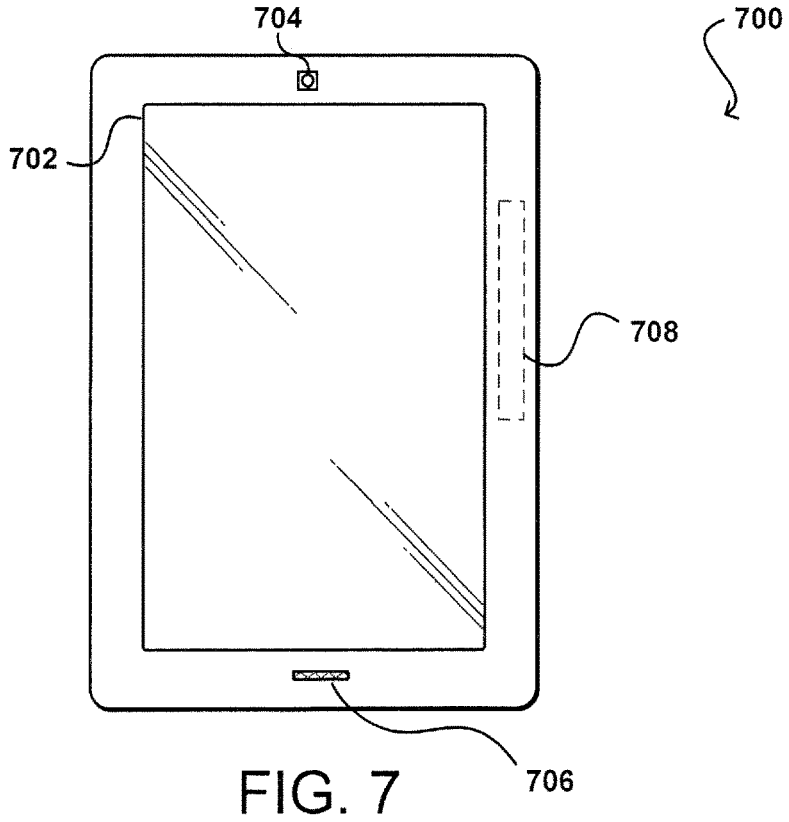
FIG. 7 illustrates an example device that can be used to implement aspects of the various embodiments.

FIG. 7 illustrates an example electronic user device 700 that can be used in accordance with various embodiments. Although a portable computing device (e.g., an electronic book reader or tablet computer) is shown, it should be understood that any electronic device capable of receiving, determining, and/or processing input can be used in accordance with various embodiments discussed herein, where the devices can include, for example, desktop computers, notebook computers, personal data assistants, smart phones, gaming consoles, television set top boxes, smart televisions, wearable computers (e.g., a watch or glasses), and portable media players. In some embodiments, a computing device can be an analog device, such as a device that can perform signal processing using operational amplifiers. In this example, the computing device 700 has a display screen 702 on the front side, which under normal operation will display information to a user facing the display screen (e.g., on the same side of the computing device as the display screen). The computing device in this example includes at least one camera 704 or other imaging element for capturing still or video image information over at least a field of view of the at least one camera. In some embodiments, the computing device might only contain one imaging element, and in other embodiments the computing device might contain several imaging elements. Each image capture element may be, for example, a camera, a charge-coupled device (CCD), a motion detection sensor, or an infrared sensor, among many other possibilities. If there are multiple image capture elements on the computing device, the image capture elements may be of different types. In some embodiments, at least one imaging element can include at least one wide-angle optical element, such as a fish eye lens, that enables the camera to capture images over a wide range of angles, such as 180 degrees or more. Further, each image capture element can comprise a digital still camera, configured to capture subsequent frames in rapid succession, or a video camera able to capture streaming video.

The example computing device 700 also includes at least one microphone 706 or other audio capture device capable of capturing audio data, such as words or commands spoken by a user of the device. In this example, a microphone 706 is placed on the same side of the device as the display screen 702, such that the microphone will typically be better able to capture words spoken by a user of the device. In at least some embodiments, a microphone can be a directional microphone that captures sound information from substantially directly in front of the microphone, and picks up only a limited amount of sound from other directions. It should be understood that a microphone might be located on any appropriate surface of any region, face, or edge of the device in different embodiments, and that multiple microphones can be used for audio recording and filtering purposes, etc.

The example computing device 700 also includes at least one orientation sensor 708, such as a position and/or movement-determining element. Such a sensor can include, for example, an accelerometer or gyroscope operable to detect an orientation and/or change in orientation of the computing device, as well as small movements of the device. An orientation sensor also can include an electronic or digital compass, which can indicate a direction (e.g., north or south) in which the device is determined to be pointing (e.g., with respect to a primary axis or other such aspect). An orientation sensor also can include or comprise a global positioning system (GPS) or similar positioning element operable to determine relative coordinates for a position of the computing device, as well as information about relatively large movements of the device. Various embodiments can include one or more such elements in any appropriate combination. As should be understood, the algorithms or mechanisms used for determining relative position, orientation, and/or movement can depend at least in part upon the selection of elements available to the device.

Figure 8:
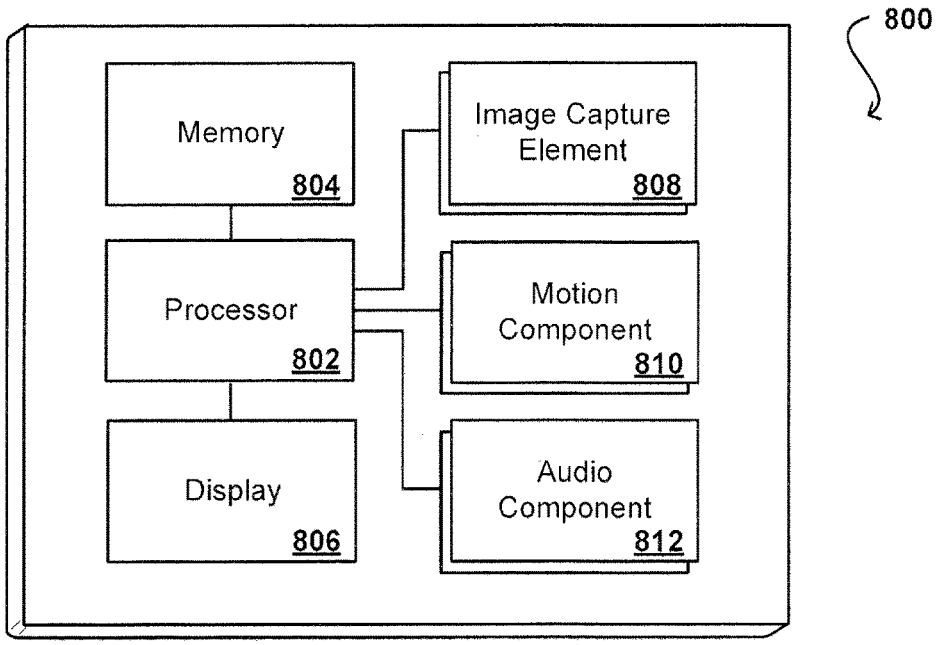
FIG. 8 illustrates example components of a client device such as that illustrated in FIG. 7.

FIG. 8 illustrates a logical arrangement of a set of general components of an example computing device 800 such as the device 700 described with respect to FIG. 7. In this example, the device includes a processor 802 for executing instructions that can be stored in a memory device or element 804. As would be apparent to one of ordinary skill in the art, the device can include many types of memory, data storage, or non-transitory computer-readable storage media, such as a first data storage for program instructions for execution by the processor 802, a separate storage for images or data, a removable memory for sharing information with other devices, etc. The device typically will include some type of display element 806, such as a touch screen or liquid crystal display (LCD), although devices such as portable media players might convey information via other means, such as through audio speakers. As discussed, the device in many embodiments will include at least one image capture element 808 such as a camera or infrared sensor that is able to image projected images or other objects in the vicinity of the device. Methods for capturing images or video using a camera element with a computing device are well known in the art and will not be discussed herein in detail. It should be understood that image capture can be performed using a single image, multiple images, periodic imaging, continuous image capturing, image streaming, etc. Further, a device can include the ability to start and/or stop image capture, such as when receiving a command from a user, application, or other device. The example device similarly includes at least one audio capture component 812, such as a mono or stereo microphone or microphone array, operable to capture audio information from at least one primary direction. A microphone can be a uni- or omni-directional microphone as known for such devices.

In some embodiments, the computing device 800 of FIG. 8 can include one or more communication elements (not shown), such as a Wi-Fi, Bluetooth, RF, wired, or wireless communication system. The device in many embodiments can communicate with a network, such as the Internet, and may be able to communicate with other such devices. In some embodiments the device can include at least one additional input device able to receive conventional input from a user. This conventional input can include, for example, a push button, touch pad, touch screen, wheel, joystick, keyboard, mouse, keypad, or any other such device or element whereby a user can input a command to the device. In some embodiments, however, such a device might not include any buttons at all, and might be controlled only through a combination of visual and audio commands, such that a user can control the device without having to be in contact with the device.

The device 800 also can include at least one orientation or motion sensor 810. As discussed, such a sensor can include an accelerometer or gyroscope operable to detect an orientation and/or change in orientation, or an electronic or digital compass, which can indicate a direction in which the device is determined to be facing. The mechanism(s) also (or alternatively) can include or comprise a global positioning system (GPS) or similar positioning element operable to determine relative coordinates for a position of the computing device, as well as information about relatively large movements of the device. The device can include other elements as well, such as may enable location determinations through triangulation or another such approach. These mechanisms can communicate with the processor 802, whereby the device can perform any of a number of actions described or suggested herein.

As an example, a computing device such as that described with respect to FIG. 7 can capture and/or track various information for a user over time. This information can include any appropriate information, such as location, actions (e.g., sending a message or creating a document), user behavior (e.g., how often a user performs a task, the amount of time a user spends on a task, the ways in which a user navigates through an interface, etc.), user preferences (e.g., how a user likes to receive information), open applications, submitted requests, received calls, and the like. As discussed above, the information can be stored in such a way that the information is linked or otherwise associated whereby a user can access the information using any appropriate dimension or group of dimensions.

Figure 9:
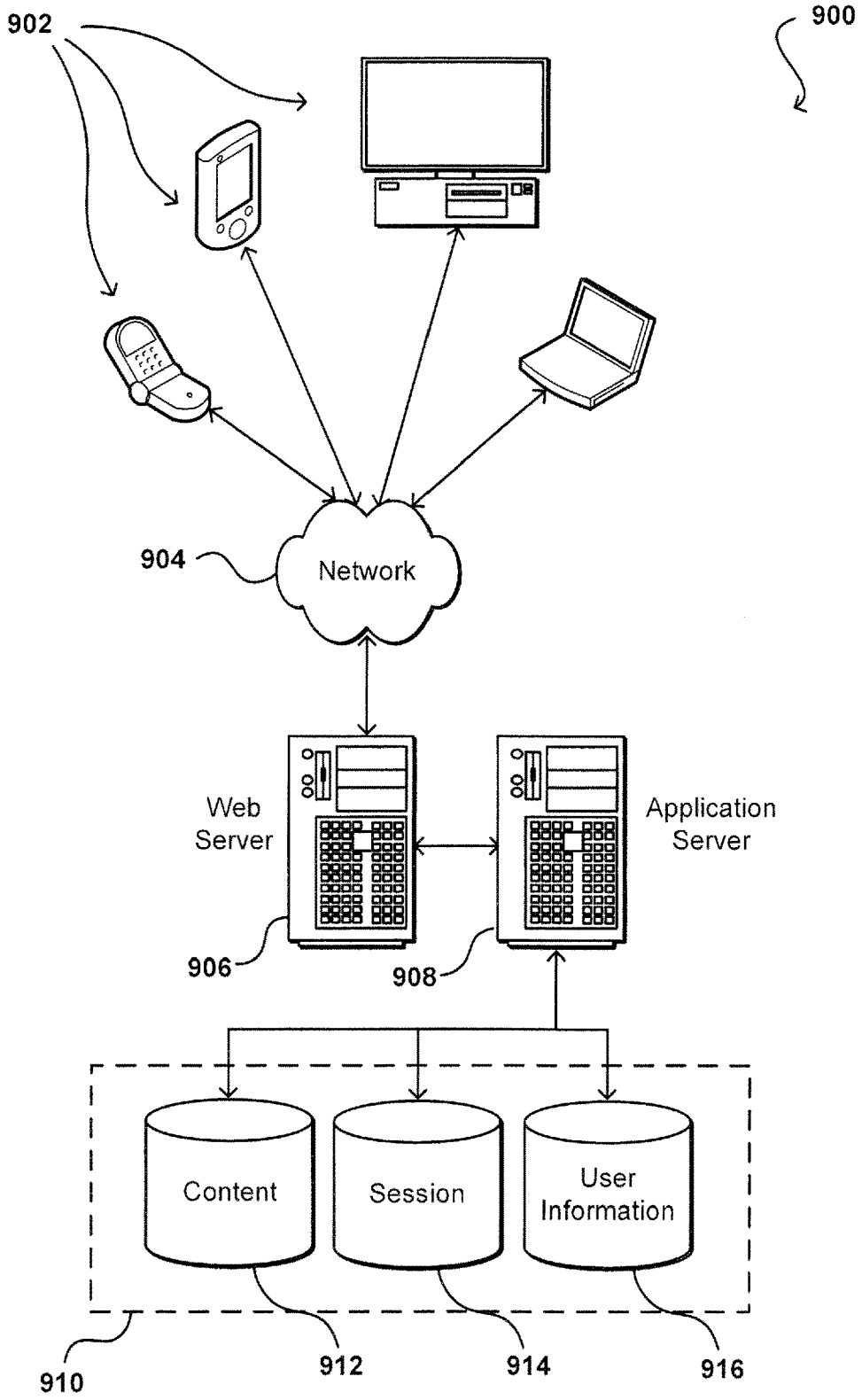
FIG. 9 illustrates an environment in which various embodiments can be implemented.

As discussed, different approaches can be implemented in various environments in accordance with the described embodiments. For example, FIG. 9 illustrates an example of an environment 900 for implementing aspects in accordance with various embodiments. As will be appreciated, although a Web-based environment is used for purposes of explanation, different environments may be used, as appropriate, to implement various embodiments. The system includes an electronic client device 902, which can include any appropriate device operable to send and receive requests, messages or information over an appropriate network 904 and convey information back to a user of the device. Examples of such client devices include personal computers, cell phones, handheld messaging devices, laptop computers, set-top boxes, personal data assistants, electronic book readers and the like. The network can include any appropriate network, including an intranet, the Internet, a cellular network, a local area network or any other such network or combination thereof. Components used for such a system can depend at least in part upon the type of network and/or environment selected. Protocols and components for communicating via such a network are well known and will not be discussed herein in detail. Communication over the network can be enabled via wired or wireless connections and combinations thereof. In this example, the network includes the Internet, as the environment includes a Web server 906 for receiving requests and serving content in response thereto, although for other networks an alternative device serving a similar purpose could be used, as would be apparent to one of ordinary skill in the art.

The illustrative environment includes at least one application server 908 and a data store 910. It should be understood that there can be several application servers, layers or other elements, processes or components, which may be chained or otherwise configured, which can interact to perform tasks such as obtaining data from an appropriate data store. As used herein the term "data store" refers to any device or combination of devices capable of storing, accessing and retrieving data, which may include any combination and number of data servers, databases, data storage devices and data storage media, in any standard, distributed or clustered environment. The application server can include any appropriate hardware and software for integrating with the data store as needed to execute aspects of one or more applications for the client device and handling a majority of the data access and business logic for an application. The application server provides access control services in cooperation with the data store and is able to generate content such as text, graphics, audio and/or video to be transferred to the user, which may be served to the user by the Web server in the form of HTML, XML or another appropriate structured language in this example. The handling of all requests and responses, as well as the delivery of content between the client device 902 and the application server 908, can be handled by the Web server 906. It should be understood that the Web and application servers are not required and are merely example components, as structured code discussed herein can be executed on any appropriate device or host machine as discussed elsewhere herein.

The data store 910 can include several separate data tables, databases or other data storage mechanisms and media for storing data relating to a particular aspect. For example, the data store illustrated includes mechanisms for storing production data 912 and user information 916, which can be used to serve content for the production side. The data store also is shown to include a mechanism for storing log or session data 914. It should be understood that there can be many other aspects that may need to be stored in the data store, such as page image information and access rights information, which can be stored in any of the above listed mechanisms as appropriate or in additional mechanisms in the data store 910. The data store 910 is operable, through logic associated therewith, to receive instructions from the application server 908 and obtain, update or otherwise process data in response thereto. In one example, a user might submit a search request for a certain type of element. In this case, the data store might access the user information to verify the identity of the user and can access the catalog detail information to obtain information about elements of that type. The information can then be returned to the user, such as in a results listing on a Web page that the user is able to view via a browser on the user device 902. Information for a particular element of interest can be viewed in a dedicated page or window of the browser.

Each server typically will include an operating system that provides executable program instructions for the general administration and operation of that server and typically will include computer-readable medium storing instructions that, when executed by a processor of the server, allow the server to perform its intended functions. Suitable implementations for the operating system and general functionality of the servers are known or commercially available and are readily implemented by persons having ordinary skill in the art, particularly in light of the disclosure herein.

The environment in one embodiment is a distributed computing environment utilizing several computer systems and components that are interconnected via communication links, using one or more computer networks or direct connections. However, it will be appreciated by those of ordinary skill in the art that such a system could operate equally well in a system having fewer or a greater number of components than are illustrated in FIG. 9. Thus, the depiction of the system 900 in FIG. 9 should be taken as being illustrative in nature and not limiting to the scope of the disclosure.

As discussed above, the various embodiments can be implemented in a wide variety of operating environments, which in some cases can include one or more user computers, computing devices, or processing devices which can be used to operate any of a number of applications. User or client devices can include any of a number of general purpose personal computers, such as desktop or laptop computers running a standard operating system, as well as cellular, wireless, and handheld devices running mobile software and capable of supporting a number of networking and messaging protocols. Such a system also can include a number of workstations running any of a variety of commercially-available operating systems and other known applications for purposes such as development and database management. These devices also can include other electronic devices, such as dummy terminals, thin-clients, gaming systems, and other devices capable of communicating via a network.

Various aspects also can be implemented as part of at least one service or Web service, such as may be part of a service-oriented architecture. Services such as Web services can communicate using any appropriate type of messaging, such as by using messages in extensible markup language (XML) format and exchanged using an appropriate protocol such as SOAP (derived from the "Simple Object Access Protocol"). Processes provided or executed by such services can be written in any appropriate language, such as the Web Services Description Language (WSDL). Using a language such as WSDL allows for functionality such as the automated generation of client-side code in various SOAP frameworks.

Most embodiments utilize at least one network that would be familiar to those skilled in the art for supporting communications using any of a variety of commercially-available protocols, such as TCP/IP, OSI, FTP, UPnP, NFS, CIFS, and AppleTalk. The network can be, for example, a local area network, a wide-area network, a virtual private network, the Internet, an intranet, an extranet, a public switched telephone network, an infrared network, a wireless network, and any combination thereof.

In embodiments utilizing a Web server, the Web server can run any of a variety of server or mid-tier applications, including HTTP servers, FTP servers, CGI servers, data servers, Java servers, and business application servers. The server(s) also may be capable of executing programs or scripts in response requests from user devices, such as by executing one or more Web applications that may be implemented as one or more scripts or programs written in any programming language, such as Java®, C, C# or C++, or any scripting language, such as Perl, Python, or TCL, as well as combinations thereof. The server(s) may also include database servers, including without limitation those commercially available from Oracle®, Microsoft®, Sybase®, and IBM®.

The environment can include a variety of data stores and other memory and storage media as discussed above. These can reside in a variety of locations, such as on a storage medium local to (and/or resident in) one or more of the computers or remote from any or all of the computers across the network. In a particular set of embodiments, the information may reside in a storage-area network ("SAN") familiar to those skilled in the art. Similarly, any necessary files for performing the functions attributed to the computers, servers, or other network devices may be stored locally and/or remotely, as appropriate. Where a system includes computerized devices, each such device can include hardware elements that may be electrically coupled via a bus, the elements including, for example, at least one central processing unit (CPU), at least one input device (e.g., a mouse, keyboard, controller, touch screen, or keypad), and at least one output device (e.g., a display device, printer, or speaker). Such a system may also include one or more storage devices, such as disk drives, optical storage devices, and solid-state storage devices such as random access memory ("RAM") or read-only memory ("ROM"), as well as removable media devices, memory cards, flash cards, etc.

Such devices also can include a computer-readable storage media reader, a communications device (e.g., a modem, a network card (wireless or wired), an infrared communication device, etc.), and working memory as described above. The computer-readable storage media reader can be connected with, or configured to receive, a computer-readable storage medium, representing remote, local, fixed, and/or removable storage devices as well as storage media for temporarily and/or more permanently containing, storing, transmitting, and retrieving computer-readable information. The system and various devices also typically will include a number of software applications, modules, services, or other elements located within at least one working memory device, including an operating system and application programs, such as a client application or Web browser. It should be appreciated that alternate embodiments may have numerous variations from that described above. For example, customized hardware might also be used and/or particular elements might be implemented in hardware, software (including portable software, such as applets), or both. Further, connection to other computing devices such as network input/output devices may be employed.

Storage media and computer readable media for containing code, or portions of code, can include any appropriate media known or used in the art, including storage media and communication media, such as but not limited to volatile and non-volatile, removable and non-removable media implemented in any method or technology for storage and/or transmission of information such as computer readable instructions, data structures, program modules, or other data, including RAM, ROM, EEPROM, flash memory or other memory technology, CD-ROM, digital versatile disk (DVD) or other optical storage, magnetic cassettes, magnetic tape, magnetic disk storage or other magnetic storage devices, or any other medium which can be used to store the desired information and which can be accessed by the a system device. Based on the disclosure and teachings provided herein, a person of ordinary skill in the art will appreciate other ways and/or methods to implement the various embodiments.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. A computing device comprising:

a housing having a front side, a rear side opposite the front side, and at least one corner disposed between the front side and the rear side;

a display screen positioned proximate to the front side of the housing;

a folded monopole antenna for operating over a range of frequencies including at least one global positioning system (GPS) frequency and at least one high band frequency, the folded monopole antenna having a substantially curved structure shaped to fit within an allowable proximity of the at least one corner of the housing, the folded monopole antenna comprising:

a first conducting element associated with a first end of the folded monopole antenna; and a second conducting element associated with a second end of the folded monopole antenna, wherein the first conducting element and the second conducting element are substantially parallel to each other in at least one plane that is substantially perpendicular to the display screen;

an impedance matching circuit connected to the folded monopole antenna, the impedance matching circuit configured to match an impedance associated with a signal, received from the folded monopole antenna, to a specified impedance; and a signal extraction circuit in communication with the impedance matching circuit, the signal extraction circuit being configured to separate the signal into at least a GPS signal portion and a high band signal portion.

2. The computing device of claim 1, further comprising at least one of:

a second impedance matching circuit in communication with the signal extraction circuit, the second impedance matching circuit being configured to match the GPS signal portion to a specified GPS impedance; or a third impedance matching circuit in communication with the signal extraction circuit, the third impedance matching circuit being configured to match the high band signal portion to a specified high band impedance.

3. The computing device of claim 2, wherein at least one of the impedance matching circuit, the second impedance matching circuit, or the third impedance matching circuit is formed, at least in part, using at least one of a transformer, a resistor, an inductor, a capacitor, or a transmission line, and wherein at least one of the impedance matching circuit, the second impedance matching circuit, or the third impedance matching circuit is tunable to one or more specified frequencies or frequency ranges.

4. The computing device of claim 1, wherein the housing includes an interior wall structure that includes a support element, wherein the first conducting element is coupled to the support element to provide structural support and electrical grounding for the folded monopole antenna.

5. The computing device of claim 1, further comprising:

at least one transceiver; and a feeding element connected to the second conducting element, the feeding element being fabricated using, at least in part, a conductive material and being configured to facilitate communications between the folded monopole antenna and the at least one transceiver.

6. A computing system comprising:

a housing having a front side, a rear side opposite the front side, and at least one corner disposed between the front side and the rear side;

a display screen positioned proximate to the front side of the housing;

a folded monopole antenna configured to operate over a range of frequencies including at least one global positioning system (GPS) frequency and at least one high band frequency, the folded monopole antenna comprises two conducting elements positioned substantially parallel to each other in at least one plane that is substantially perpendicular to the front side of the housing, wherein the folded monopole antenna forms substantially curved structure that fits within an allowable proximity of the at least one corner of the housing;

at least one processor; and a memory having instructions that, when executed by the at least one processor, cause the computing system to:

receive a signal via the folded monopole antenna;

match the signal to a specified impedance within an allowable deviation; and separate the signal into at least a first signal portion and a second signal portion, the first signal portion being associated with the at least one GPS frequency and the second signal portion being associated with the at least one high band frequency.

7. The computing system of claim 6, further comprising:

a GPS port configured to facilitate in processing GPS data; and a high band port configured to facilitate in processing high band data, wherein the at least one processor further causes the computing system to transmit the first signal portion to the GPS port and the second signal portion to the high band port.

8. The computing system of claim 6, further comprising:

an impedance matching unit configured to match the signal to the specified impedance within the allowable deviation, wherein the impedance matching unit performs at least one of maximizing transferred power to improve a signal quality associated with the signal or minimizing signal refection to improve a signal to noise ratio associated with the signal.

9. The computing system of claim 6, further comprising at least one of:

a GPS impedance matching unit configured to match the first signal portion to a specified GPS impedance; or a high band impedance matching unit configured to match the second signal portion to a specified high band impedance.

10. The computing system of claim 9, wherein the high band impedance matching unit tunes the second signal portion to correspond to one or more target high band frequencies.

11. The computing system of claim 6, wherein the folded monopole antenna is fabricated using at least one of a laser direct structuring process, a metal stamping process, a flex circuit process, a two-shot molding process, an inkjet printing process, or a pad printing process.

12. The computing system of claim 6, wherein the folded monopole antenna comprises a first layer of copper material, a second layer of nylon material, and a third layer of gold plating material.

13. The computing system of claim 6, wherein the specified impedance is 50 Ohms.

14. The computing system of claim 6, wherein the folded monopole antenna transmits or receives signals within an allowable deviation from a frequency range of 1.55 GHz to 2.7 GHz.

15. The computing system of claim 6, wherein a trace length of the folded monopole antenna is within an allowable deviation of 10 millimeters.

16. The computing system of claim 6, wherein the housing includes an interior frame that includes a support element, wherein the support element couples the one of the two conducting elements to provide structural support and electrical grounding for the folded monopole antenna.

17. The computing system of claim 6, further comprising:

at least one transceiver; and a feeding element connected to at least one of the conducting elements, the feeding element being fabricated using, at least in part, a conductive material and being configured to facilitate communications between the folded monopole antenna and the at least one transceiver.

18. A computer-implemented method comprising:

receiving, via at least one of two conducting elements of a folded monopole antenna positioned in within a housing of a computing device, signals over a range of frequencies including at least one global positioning system (GPS) frequency and at least one high band frequency, the housing includes a front side, a rear side opposite the front side, and at least one corner disposed between the front side and the rear side, the two conducting elements are positioned substantially parallel to each other in at least one plane substantially perpendicular to a display screen located proximate to the front side of the housing, wherein the folded monopole antenna forms a substantially curved structure that fits within an allowable proximity of the at least one corner of the housing;

securing at least one of the two conducting elements to the housing using a clip that provides electrical ground for the folded monopole antenna;

matching at least one signal to a specified impedance within an allowable deviation using, at least in part, an impedance matching unit;

separating the signal into at least a first signal portion and a second signal portion, the first signal portion being associated with the at least one GPS frequency and the second signal portion being associated with the at least one high band frequency; and transmitting the first signal portion to a GPS signal processing element of the computing device and the second signal portion to a high band signal processing element of the computing device.

19. The computer-implemented method of claim 18, further comprising at least one of:

matching the first signal portion to a specified GPS impedance prior to the first signal portion being transmitted to the GPS signal processing element; or matching the second signal portion to a specified high band impedance prior to the second signal portion being transmitted to the high band signal processing element.

20. The computer-implemented method of claim 19, wherein the second signal portion is tunable to one or more target high band frequencies.

* * * * *